US007178581B2

(12) United States Patent
St. Pierre et al.

(10) Patent No.: US 7,178,581 B2
(45) Date of Patent: Feb. 20, 2007

(54) PLATE-TYPE HEAT EXCHANGER

(75) Inventors: Michel St. Pierre, Hamilton (CA); Thomas F. Seiler, Compiegne (FR); Pascal Bradu, Compiegne (FR)

(73) Assignee: Dana Canada Corporation (CA)

( * ) Notice: Subject to any disclaimer, the term of this patent is extended or adjusted under 35 U.S.C. 154(b) by 186 days.

(21) Appl. No.: 10/967,988

(22) Filed: Oct. 19, 2004

(65) Prior Publication Data

US 2006/0081358 A1 Apr. 20, 2006

(51) Int. Cl.
*F28F 7/00* (2006.01)

(52) U.S. Cl. ..... 165/81; 165/167; 165/916

(58) Field of Classification Search ..... 165/81, 165/166, 167, 916, DIG. 360, DIG. 356, 165/DIG. 361
See application file for complete search history.

(56) References Cited

U.S. PATENT DOCUMENTS

| | | | | |
|---|---|---|---|---|
| 2,677,531 | A | 5/1954 | Hock, Sr. et al. | |
| 4,271,901 | A * | 6/1981 | Buchmuller | 165/165 |
| 4,561,494 | A * | 12/1985 | Frost | 165/76 |
| 4,708,199 | A | 11/1987 | Yogo et al. | |
| 4,742,866 | A | 5/1988 | Yamanaka et al. | |
| 4,872,578 | A | 10/1989 | Fuerschbach et al. | |
| 4,892,136 | A | 1/1990 | Ichihara et al. | |
| 5,014,775 | A * | 5/1991 | Watanabe | 165/167 |
| 5,078,209 | A | 1/1992 | Kerkman et al. | |
| 5,146,980 | A | 9/1992 | Le Gauyer | |
| 5,154,225 | A | 10/1992 | Armbruster et al. | |
| 5,179,999 | A | 1/1993 | Meekins et al. | |
| 5,513,702 | A | 5/1996 | Tajima et al. | |
| 5,538,593 | A | 7/1996 | Sakai et al. | |
| 5,765,632 | A | 6/1998 | Gire | |
| 5,954,126 | A * | 9/1999 | Armbruster | 165/167 |
| 6,182,748 | B1 | 2/2001 | Brost et al. | |
| 6,199,626 | B1 | 3/2001 | Wu et al. | |
| 6,244,334 | B1 | 6/2001 | Wu et al. | |
| 6,863,122 | B2 | 3/2005 | St. Pierre et al. | |
| 7,007,749 | B2 * | 3/2006 | Brost et al. | 165/167 |
| 2004/0040697 | A1 | 3/2004 | St. Pierre et al. | |

FOREIGN PATENT DOCUMENTS

| | | |
|---|---|---|
| EP | 0 108 377 | 5/1984 |
| JP | 39-25540 | 9/1939 |

* cited by examiner

*Primary Examiner*—Teresa J. Walberg
(74) *Attorney, Agent, or Firm*—Dykema Gossett PLLC

(57) ABSTRACT

A heat exchanger has oil core plates and coolant core plates disposed in alternating, stacked relationship. Flow passages are provided between adjacent plates, so that the oil flow passages alternate with the coolant flow passages, and the oil can flow from an oil inlet opening of each oil plate, and through the oil flow passage to an oil outlet opening, and coolant can flow from a coolant inlet opening of each coolant plate through the coolant flow passage to a coolant outlet opening. The oil inlet openings are adjacent to one end of the plates, and the oil outlet openings are spaced from the oil inlet openings, with a passageway for flow of the oil between upstanding bosses of the coolant plates on opposed sides of each oil plate and extending from a gap in an upstanding flange of the oil plate to the oil outlet opening.

24 Claims, 8 Drawing Sheets

PLATE-TYPE HEAT EXCHANGER

FIELD OF THE INVENTION

This invention relates to plate-type heat exchangers for effecting heat transfer between two fluids, for example between a lubricating oil and a liquid coolant.

BACKGROUND OF THE INVENTION

Plate-type heat exchangers comprising a stack of heat exchanger plates are well known. Such heat exchangers are commonly employed for effecting heat transfer between a first fluid, for example a lubricating oil to be cooled, and a second fluid, for example a liquid coolant.

There is a need for improved heat exchangers of this type which are economical to manufacture and in which the heat transfer between the fluids is optimized.

SUMMARY OF THE INVENTION

In accordance with the present invention there is provided a heat exchanger comprising a plurality of first fluid core plates and a plurality of second fluid core plates, each of the core plates comprising a periphery; a first end; a second end; a generally flat base having a top surface and a bottom surface; a first fluid inlet opening proximate the first end of the plate; a first fluid outlet opening spaced from the first fluid inlet opening toward the second end of the plate; a second fluid inlet opening; and a second fluid outlet opening;

wherein the first fluid inlet and outlet openings are spaced from one another along a plate axis and wherein the second fluid inlet and outlet openings are located on opposite sides of the plate axis;

each of the first fluid core plates further comprises a first raised barrier portion having an upper surface which is raised relative to the top surface of the base and relative to the first fluid inlet and outlet openings, the first raised barrier portion having a first end proximate the first fluid inlet opening and a second end spaced from the first fluid inlet opening toward the second end of the plate, the second end of the first raised barrier portion being spaced toward the second end of the plate relative to the first fluid outlet opening, with a first fluid flow gap being provided between the second end of the first raised barrier portion and the second end of the plate through which the first fluid can flow between the first fluid inlet and outlet openings;

each of the first fluid core plates further comprises a first recessed barrier portion having a lower surface which is recessed relative to the bottom surface of the base, with both the first fluid inlet and outlet openings being formed in the first recessed barrier portion, the first recessed barrier portion having a first end proximate the first end of the plate and a second end proximate the second end of the plate, wherein a second fluid flow gap is provided through which the second fluid can flow between the second fluid inlet and outlet openings, the second fluid flow gap being spaced toward the first end of the plate relative to at least one of the second fluid inlet and outlet openings;

each of the second fluid core plates further comprises a second raised barrier portion having an upper surface which is raised relative to the top surface of the base, with both the first fluid inlet and outlet openings of the second plate being formed in the second raised barrier portion, the second raised barrier portion having a first end proximate the first end of the plate and a second end proximate the second end of the plate, wherein a second fluid flow gap is provided through which the second fluid can flow between the second fluid inlet and outlet openings, the second fluid flow gap being spaced toward the first end of the plate relative to at least one of the second fluid inlet and outlet openings;

each of the second fluid core plates further comprises a second recessed barrier portion having a lower surface which is recessed relative to the bottom surface of the base and relative to the first fluid inlet and outlet openings, the second recessed barrier portion having a first end proximate the first fluid inlet opening and a second end spaced from the first fluid inlet opening toward the second end of the plate, the second end of the second recessed barrier portion being spaced toward the second end of the plate relative to the first fluid outlet opening, with a first fluid flow gap being provided between the second end of the second recessed barrier portion and the second end of the plate through which the first fluid can flow between the first fluid inlet and outlet openings;

the first fluid core plates and the second fluid core plates being in alternating stacked relationship with the periphery of each first fluid core plate being sealed to the periphery of an adjacent second fluid core plate to form a plurality of fluid flow passages;

said plurality of fluid flow passages comprising a plurality of first fluid flow passages for flow of the first fluid, each of the first fluid flow passages being formed between the top surface of a first fluid core plate and the bottom surface of an upwardly adjacent second fluid core plate, with the upper surface of the first raised barrier portion of the first fluid core plate being in sealed contact with the lower surface of the second recessed barrier portion of the second fluid core plate and with the gap of the first raised barrier portion communicating with the gap of the second recessed barrier portion, such that the first fluid can flow from the first fluid inlet opening, through the first fluid flow passage, and through the gaps to the first fluid outlet opening;

said plurality of fluid flow passages further comprising a plurality of second fluid flow passages for flow of the second fluid, each of the second fluid flow passages being formed between the top surface of a second fluid core plate and the bottom surface of an upwardly adjacent first fluid core plate, with the upper surface of the second raised barrier portion of the second fluid core plate being in sealed contact with the lower surface of the first recessed barrier portion of the first fluid core plate and with the gap of the second raised barrier portion communicating with the gap of the first recessed barrier portion, such that the second fluid can flow from the second fluid inlet opening, through the second fluid flow passage, and through the gaps to the second fluid outlet opening;

wherein the first fluid flow passages alternate with the second fluid flow passages.

It will be appreciated that alternatively the first fluid may flow in the reverse direction through the first fluid flow passage in which case the first fluid outlet openings in the plates would function as first fluid inlet openings, and the first fluid inlet openings in the plates would function as first fluid outlet openings.

BRIEF DESCRIPTION OF THE DRAWINGS

In order that the invention may be more clearly understood and more readily carried into effect, the same will now, by way of example, be more fully described with reference to the accompanying drawings in which.

DETAILED DESCRIPTION OF PREFERRED EMBODIMENTS

Figure 1:
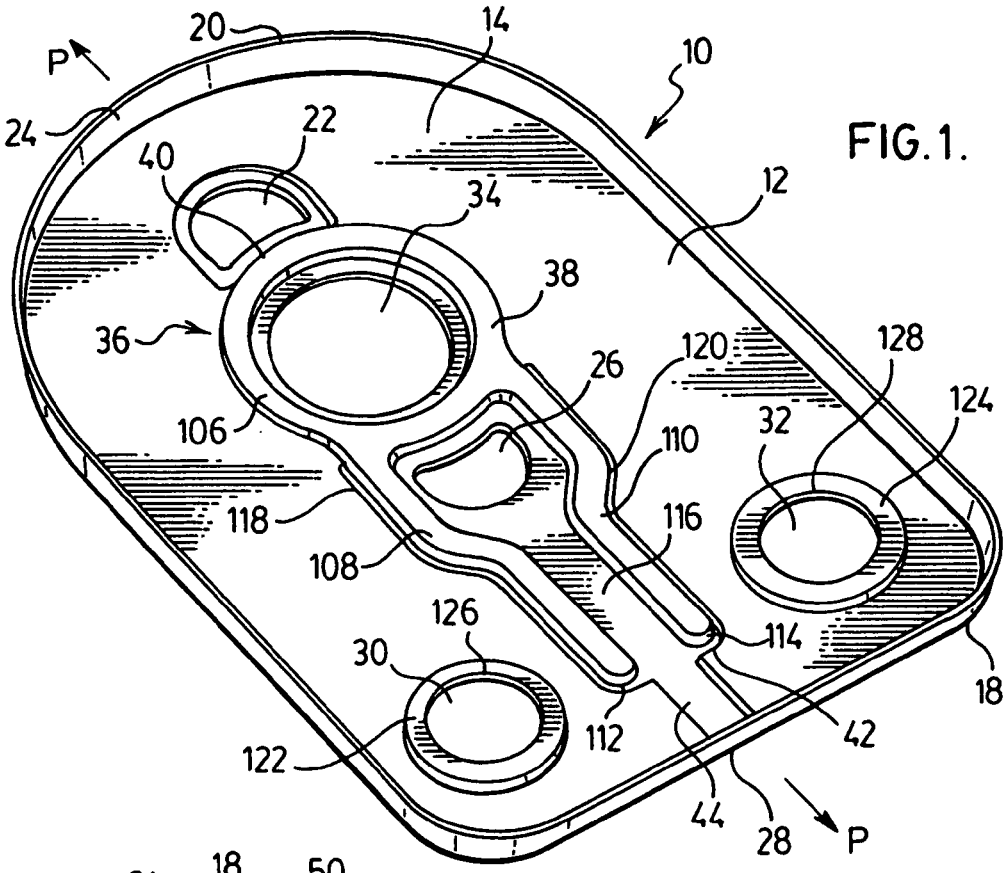
FIG. 1 is a top perspective view of an oil core plate of a heat exchanger according to a preferred embodiment of the invention.

The preferred embodiment of the invention relates to a plate-type heat exchanger for effecting heat transfer between a first fluid to be cooled and a second fluid. The first fluid may preferably comprise a lubricating oil such as natural or synthetic engine oil, transmission oil or power steering oil or other fluid to be cooled, such as fuel. The second fluid may preferably comprise a liquid coolant for cooling the oil in the heat exchanger, for example a glycol coolant. Alternatively, at least one of the first and second fluids could be, for example, water, deionized water, or refrigerant, the fluid being in liquid, gaseous or two-phase form. In the following detailed description, the first and second fluids are referred to as the oil and the coolant, respectively and are in liquid form.

Terms such as "top", "bottom", "upward", "downward", "raised", "recessed" and the like are used herein as terms of reference to describe features of the heat exchangers and heat exchanger plates according to the invention. It will be appreciated that these terms are used for convenience only, and the heat exchangers and heat exchanger plates according to the invention can have any desired orientation when in use.

The oil core plate 10 is now described in detail below with reference to FIGS. 1, 2, 5 and 6. Oil core plate 10 comprises a generally flat, planar base 12 having a top surface 14 and a bottom surface 16. In the preferred embodiment of the invention, the periphery 18 of plate 10 is provided with an upstanding flange 20, this flange 20 being outwardly inclined in a direction away from the base 12, such that there is an obtuse angle between the flange 20 and the adjacent portion of base 12. The base 12 has an oil inlet opening 22 proximate a first end 24 of plate 10 and an oil outlet opening 26 spaced from the oil inlet opening 22 toward a second end 28 of plate 10. The oil inlet and outlet openings 22, 26 are spaced from one another along a plate axis P which, in the preferred embodiment shown in the drawings, longitudinally bisects the plate 10. It will, however, be appreciated that the axis P does not necessarily bisect the plate 10.

Plate 10 further comprises a coolant inlet opening 30 and a coolant outlet opening 32 together with, in the preferred embodiment shown in the drawings, a further opening 34 located between the oil inlet and outlet openings 22, 26. The coolant inlet and outlet openings 30, 32 are preferably located on opposite sides of the plate axis P, and are preferably located proximate the second end 28 of the plate 10. The further opening 34, the purpose of which will be explained later, is preferably located between the oil inlet and outlet openings 22, 26, preferably in close proximity to openings 22, 26 and preferably located along the plate axis P.

The base 12 of oil core plate 10 is provided with a plurality of protrusions and depressions in order to direct flow of the heat exchange fluids along its top and bottom surfaces 14, 16. In particular, the core plate 10 is provided with features which protrude in opposite directions from its top and bottom surfaces 14, 16. For consistency with the terms of reference used to describe the relative orientations of the plates, the features which protrude from the top surface 14 of the base 12 are described as "raised", while those protruding from the bottom surface 16 are described as "depressed". Again, it will be appreciated that these terms are used for convenience only. These features of the oil core plate 10 are now described in detail below.

Figure 5:
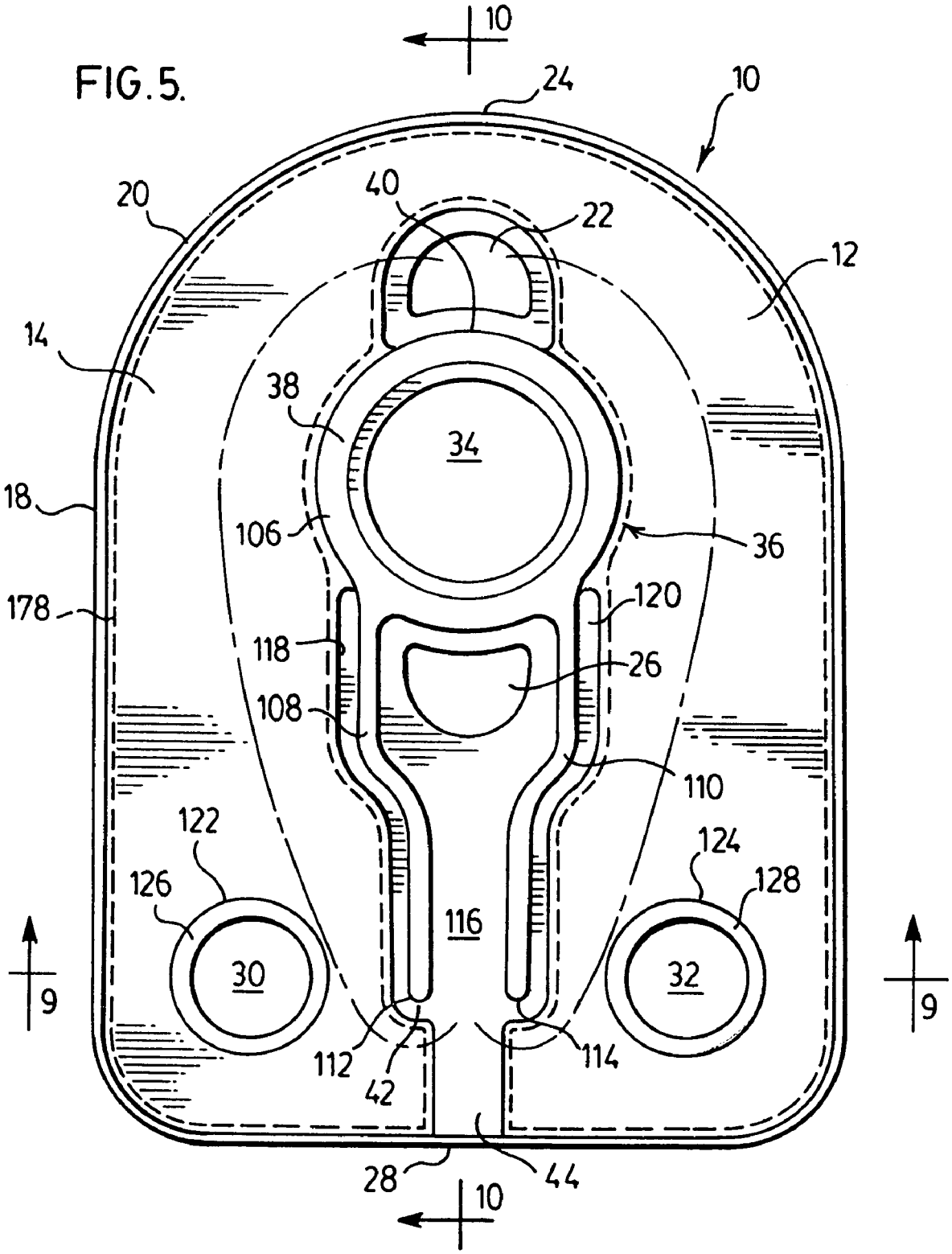
FIG. 5 is a top plan view of the oil core plate shown in FIGS. 1 and 2.

As shown in FIGS. 1 and 5, the top surface 14 of base 12 is provided with a first raised barrier portion 36 having an upper surface 38 which is raised relative to the top surface 14 of base 12 and relative to the oil inlet and outlet openings 22, 26. The function of the first raised barrier portion 36 is to direct the flow of oil along the top surface 14 of base 12 between the oil inlet and outlet openings 22, 26 in a manner which maximizes the use of the plate surface area and thereby provides optimal heat transfer with the coolant. This will be described in detail below.

The first raised barrier portion 36 has a first end 40 proximate the oil inlet opening 22 and a second end 42 spaced from the oil inlet opening 22 toward the second end 28 of plate 10. An oil flow gap 44 is preferably provided between the second end 42 of first raised barrier portion 36 and the second end 28 of the plate 10, through which oil can flow between the oil inlet and outlet openings 22, 26, as explained in detail below.

Figure 2:
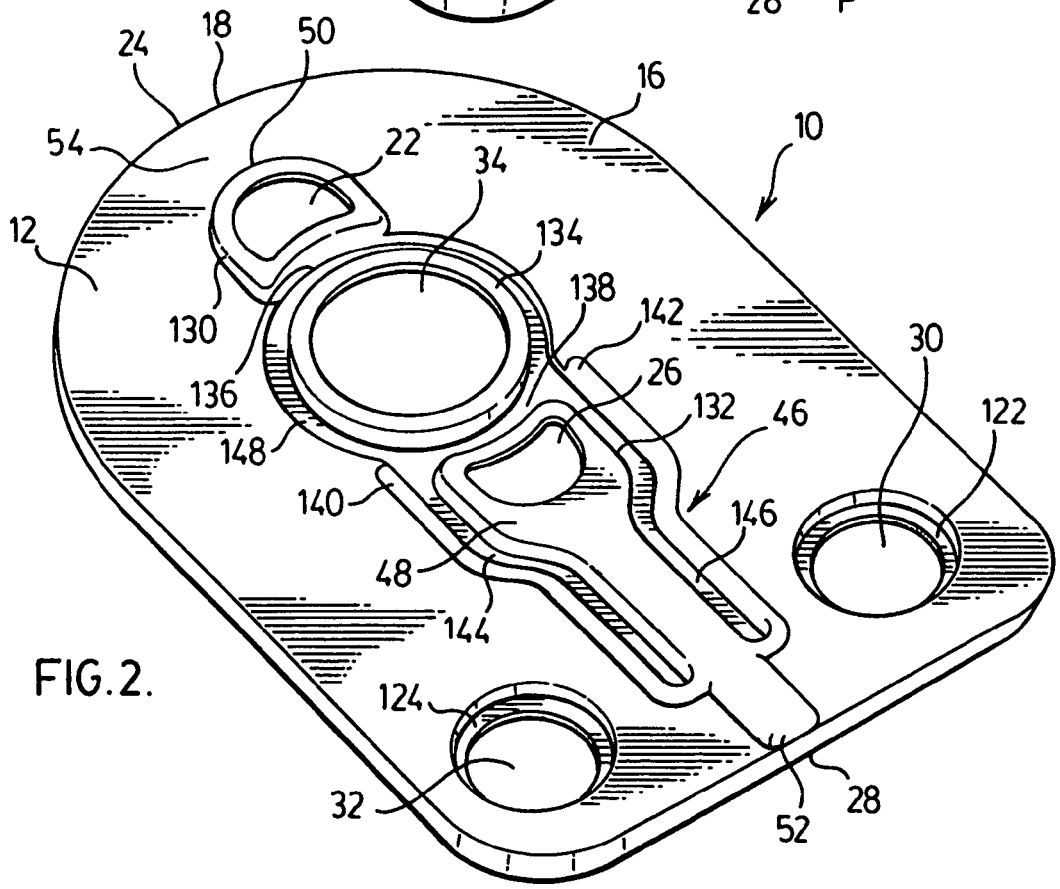
FIG. 2 is a bottom perspective view of the oil core plate shown in FIG. 1.
Figure 6:
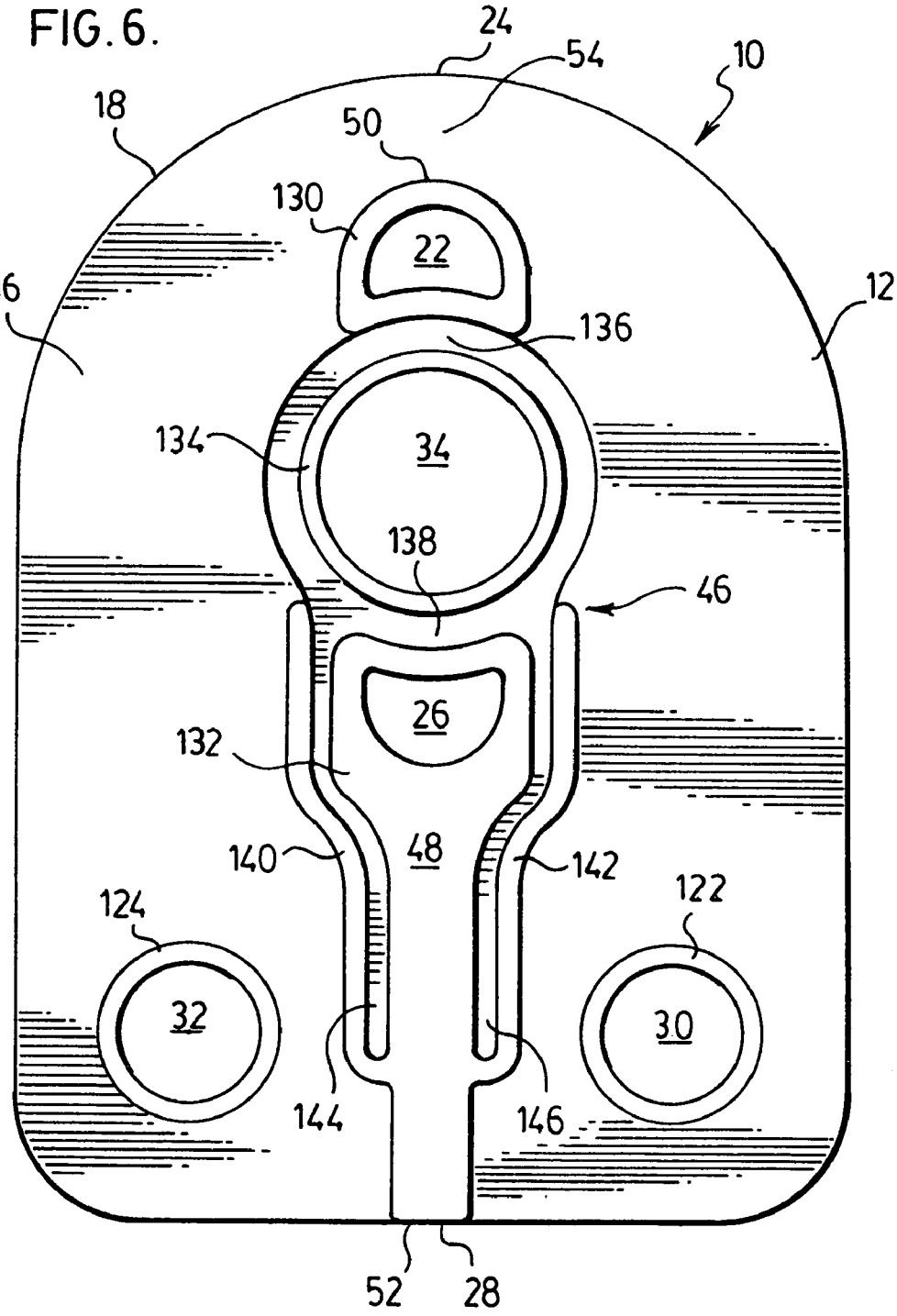
FIG. 6 is a bottom plan view of the oil core plate shown in FIGS. 1 and 2.

As shown in FIGS. 2 and 6, the bottom surface 16 of base 12 is provided with a first recessed barrier portion 46 having a lower surface 48 which is recessed relative to the bottom surface 16. The function of the first recessed barrier portion 46 is to direct the flow of coolant along the bottom surface 16 of base 12 between the coolant inlet and outlet openings 30, 32 in a manner which optimizes heat transfer with the oil. This is described in detail below.

The first recessed barrier portion 46 has a first end 50 proximate the first end 24 of plate 10 and a second end 52 proximate the second end 28 of plate 10. Both the oil inlet and outlet openings 22, 26 are formed in the lower surface 48 of the first recessed barrier portion 46, with the oil inlet opening 22 preferably being located proximate the first end 50 of barrier portion 46 and the oil outlet opening 26 preferably being located intermediate the first and second ends 50, 52 of barrier portion 46.

Preferably, as shown in the drawings, the first recessed barrier portion 46 extends along the plate axis P, with the coolant inlet and outlet openings 30, 32 being located on opposite sides of the barrier portion 46. At least one coolant flow gap is provided, either through the first recessed barrier portion 46 or between the barrier portion 46 and the first end 24 of plate 10, through which the coolant can flow generally transversely as it flows between the coolant inlet and outlet openings 30, 32. In the preferred embodiment shown in the drawings, a first coolant flow gap 54 is provided between the first end 50 of the first recessed barrier portion 46 and the first end 24 of plate 10, through which the coolant can flow between the coolant openings 30, 32. To maximize the length of the coolant flow path along the bottom surface 16 of base 12, and thereby optimize heat transfer, the coolant flow gap 54 is spaced toward the first end 24 of plate 10 relative to the coolant openings 30, 32, and preferably the coolant flow gap 54 and coolant openings 30, 32 are located at opposite ends of plate 10.

The coolant core plate 60 is now described in detail below with reference to FIGS. 3, 4, 7 and 8. Coolant core plate 60 comprises a generally flat, planar base 62 having a top surface 64 and a bottom surface 66. In the preferred embodiment of the invention, the periphery 68 of plate 60 is provided with an upstanding flange 70, this flange 70 being outwardly inclined in a direction away from the base 62, such that there is an obtuse angle between the flange 70 and the adjacent portion of base 62. The base 62 has an oil inlet opening 72 proximate a first end 74 of plate 60 and an oil outlet opening 76 spaced from the oil inlet opening 72 toward a second end 78 of plate 60, preferably along plate axis P.

Plate 60 further comprises a coolant inlet opening 80 and a coolant outlet opening 82 together with, in the preferred embodiment shown in the drawings, a further opening 84 located between the oil inlet and outlet openings 72, 76. The purpose of opening 84 will be explained in detail later. The coolant inlet and outlet openings 80, 82 are preferably located on opposite sides of the plate axis P, and are preferably located proximate the second end 78 of the plate 60. The further opening 84 is preferably located between the oil inlet and outlet openings 72, 76, preferably in close proximity to openings 72, 76 and preferably located along the plate axis P.

The base 62 of coolant core plate 60 is provided with a plurality of protrusions and depressions in order to direct flow of the heat exchange fluids along its top and bottom surfaces 64, 66. In particular, the core plate 60 is provided with features which protrude in opposite directions from its top and bottom surfaces 64, 66. As with the oil core plate, the features which protrude from the top surface 64 of the coolant core plate 60 are described as "raised", while those protruding from the bottom surface 66 are described as "depressed". Again, it will be appreciated that these terms are used for convenience only. These features of the coolant core plate 60 are now described in detail below.

Figure 3:
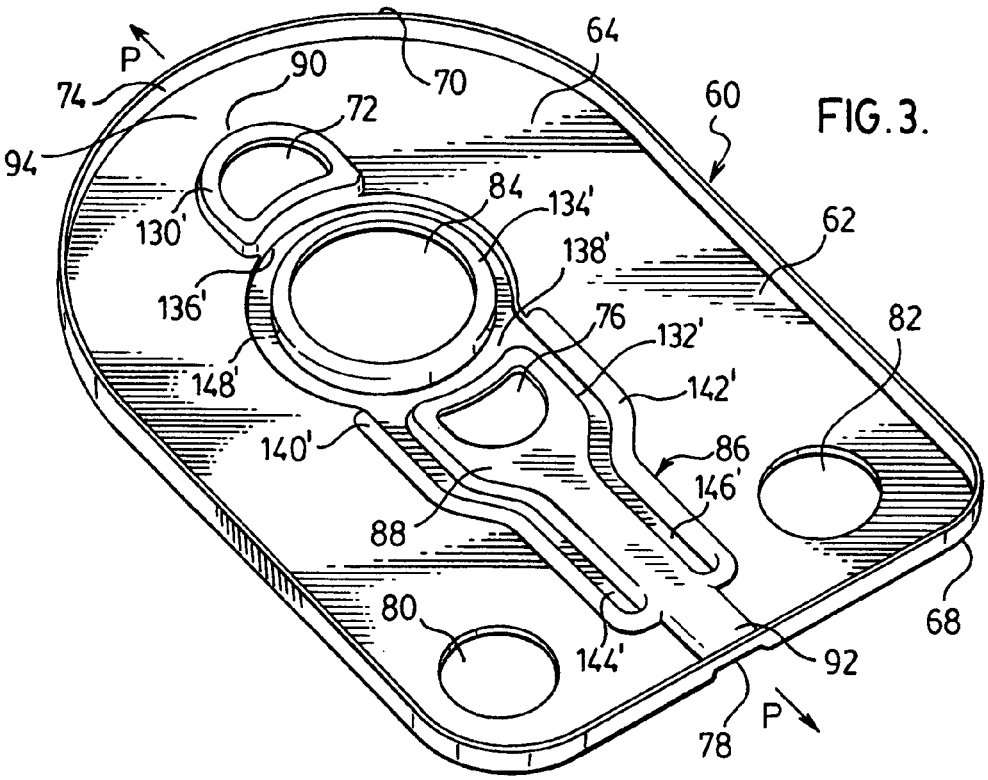
FIG. 3 is a top perspective view of a coolant core plate of the heat exchanger according to a preferred embodiment of the invention.
Figure 7:
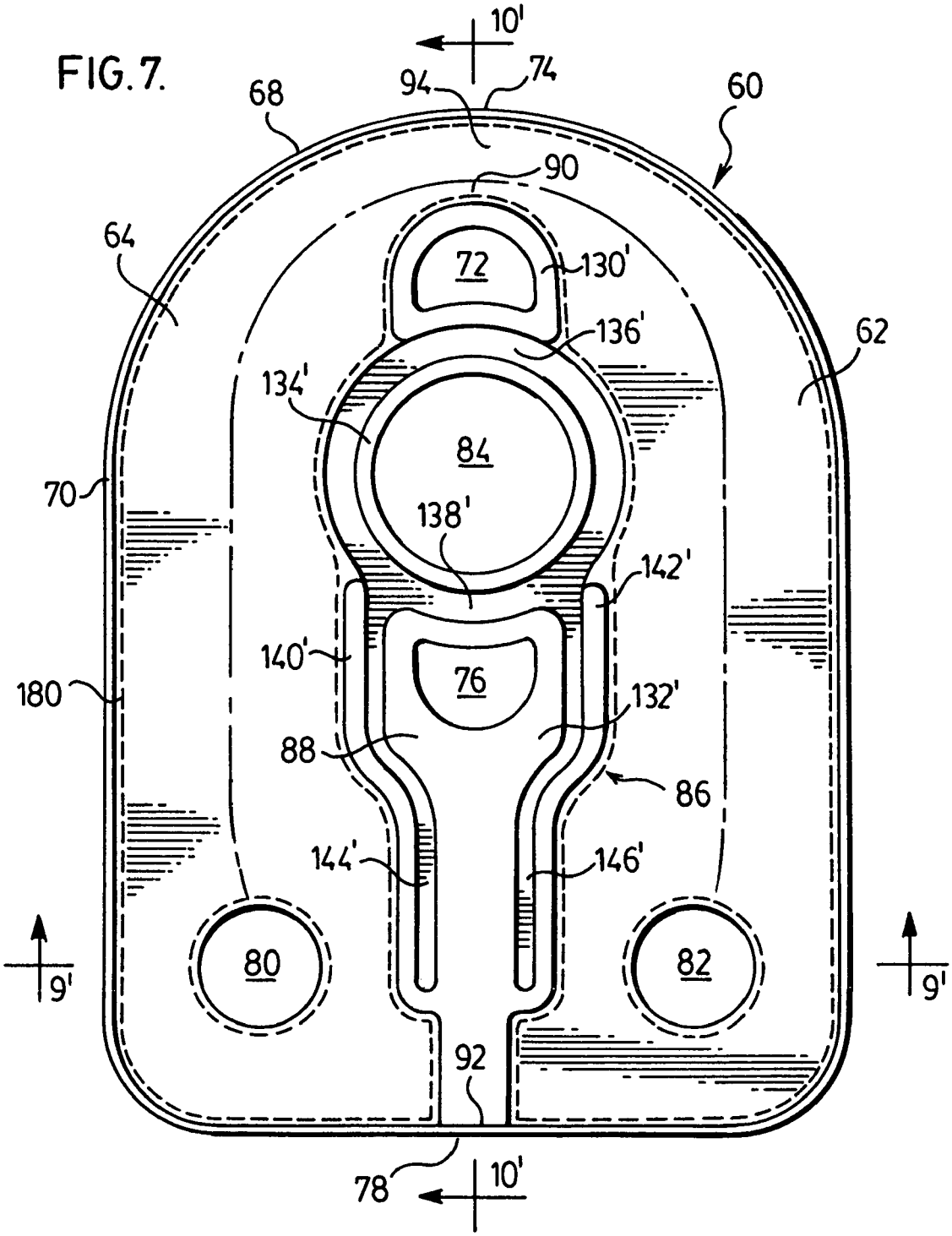
FIG. 7 is a top plan view of the coolant core plate shown in FIGS. 3 and 4.

As shown in FIGS. 3 and 7, the top surface 64 of base 62 is provided with a second raised barrier portion 86 having an upper surface 88 which is raised relative to the top surface 64. The function of the second raised barrier portion 86 is to direct the flow of coolant along the top surface 64 of base 62 between the coolant inlet and outlet openings 80, 82 in a manner which optimizes heat transfer with the oil. This is described in detail below.

The second raised barrier portion 86 has a first end 90 proximate the first end 74 of plate 60 and a second end 92 proximate the second end 78 of plate 60. Both the oil inlet and outlet openings 72, 76 are formed in the upper surface 88 of the second raised barrier portion 86, with the oil inlet opening 72 preferably being located proximate the first end 80 of barrier portion 86 and the oil outlet opening 76 preferably being located intermediate the first and second ends 90, 92 of barrier portion 86.

Preferably, as shown in the drawings, the second raised barrier portion 86 extends along the plate axis P, with the coolant inlet and outlet openings 80, 82 being located on opposite sides of the barrier portion 86. At least one coolant flow gap is provided, either through the second raised barrier portion 86 or between the barrier portion 86 and the first end 74 of plate 60, through which the coolant can flow generally transversely as it flows between the coolant inlet and outlet openings 80, 82. In the preferred embodiment shown in the drawings, a first coolant flow gap 94 is provided between the first end 90 of the second raised barrier portion 86 and the first end 74 of plate 60, through which the coolant can flow between the coolant openings 80, 82. To maximize the length of the coolant flow path along the top surface 64 of base 62, and thereby optimize heat transfer, the coolant flow gap 94 is spaced toward the first end 74 of plate 60 relative to the coolant openings 30, 32, and preferably the coolant flow gap 94 and coolant openings 80, 82 are located at opposite ends of plate 60.

Figure 4:
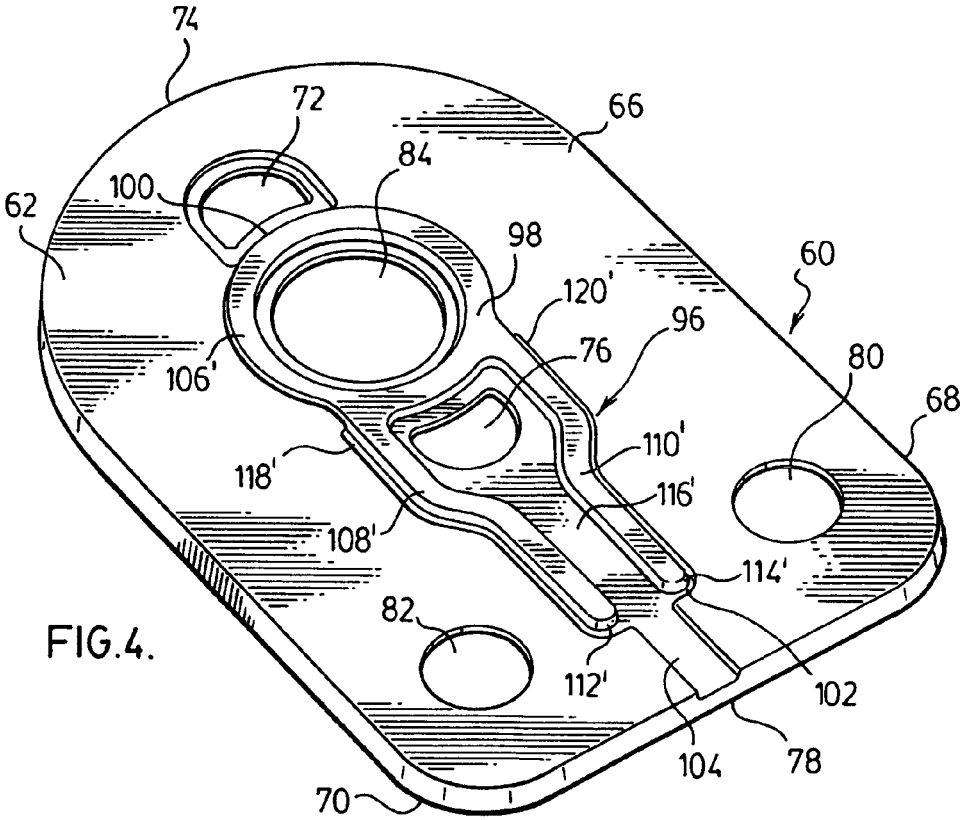
FIG. 4 is a bottom perspective view of the coolant core plate shown in FIG. 3.
Figure 8:
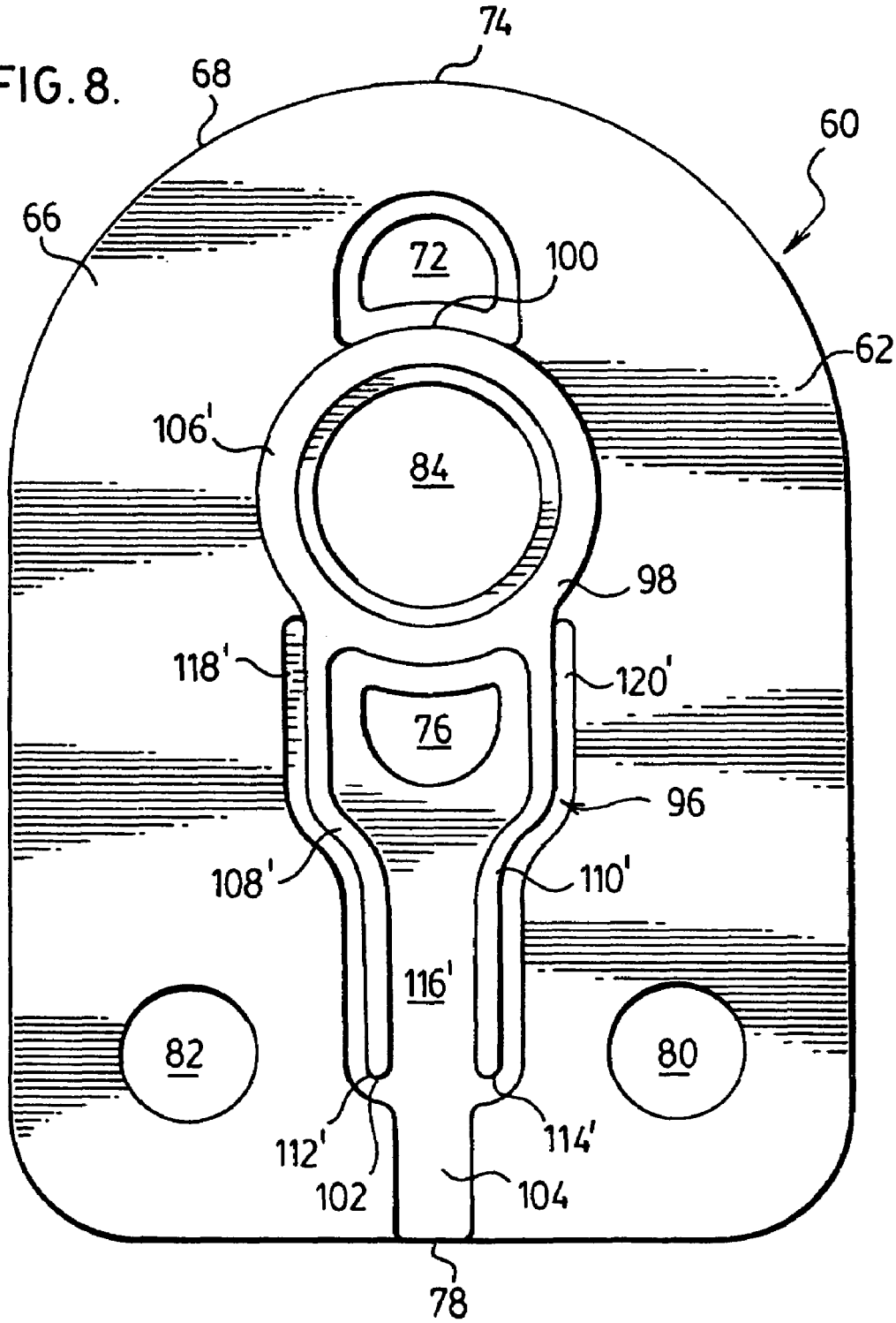
FIG. 8 is a bottom plan view of the coolant core plate shown in FIGS. 3 and 4.

As shown in FIGS. 4 and 8, the bottom surface 66 of base 62 is provided with a second recessed barrier portion 96 having a lower surface 98 which is recessed relative to the bottom surface 66 of base 62 and relative to the oil inlet and outlet openings 72, 76. The function of the second recessed barrier portion 96 is to direct the flow of oil along the bottom surface 66 of base 62 between the oil inlet and outlet openings 72, 76 in a manner which optimizes heat transfer with the coolant. This will be described in detail below.

The second recessed barrier portion 96 has a first end 100 proximate the oil inlet opening 72 and a second end 102 spaced from the oil inlet opening 72 toward the second end 78 of plate 60. An oil flow gap 104 is preferably provided between the second end 102 of second recessed barrier portion 96 and the second end 78 of the plate 60, through which oil can flow between the oil inlet and outlet openings 72, 76, as explained in detail below.

It will be appreciated from the drawings that the first raised barrier portion 36 of the oil core plate 10 and the second recessed barrier portion 96 of coolant core plate 60 correspond in size, shape and location so that their respective upper and lower surfaces 38 and 98 are in sealed contact with one another in the assembled heat exchanger. Preferred features of first raised barrier portion 36 are now described below with reference to the drawings. Except where noted to the contrary, the following discussion also applies to the second recessed barrier portion 96 of plate 60, and corresponding features of the second recessed barrier portion 96 are identified in the drawings with corresponding, primed reference numerals.

Firstly, it will be noted from FIGS. 1 and 5 that the first raised barrier portion 36 comprises a first portion 106 and a pair of legs 108, 110. The first portion 106 of barrier portion 36 is located between the oil inlet and outlet openings 22, 26 and includes the first end 40 of barrier portion 36. In the preferred embodiment shown in the drawings, the first portion 106 of barrier portion 36 comprises a raised, approximately circular rib surrounding the further opening 34 of oil core plate 10, the outer periphery of the rib being in close proximity to both the oil inlet and outlet openings 22, 26.

As shown in the drawings, the legs 108, 110 of first raised barrier portion 36 extend from the first portion 106 of barrier portion 36 toward the second end 28 of plate 10. Preferably, the terminal ends 112, 114 of legs 108, 110 are located at the second end 42 of barrier portion 36 and are proximate to the second end 28 of plate 10, with the oil flow gap 44 being defined by the distance (measured parallel to axis P) between the terminal ends 112, 114 of the legs 108, 110 and the second end 28 of plate 10.

Preferably, the legs 108, 110 extend along opposite sides of the oil outlet opening 26 for at least a portion of their lengths and are spaced apart so as to define a channel 116. With an axial distance from the terminal ends 112,114 of legs 108, 110 and the second end 28 of plate 10 preferably being less than an axial distance between the oil outlet opening 26 and the second end 28 of plate 10, the channel 116 provides a flow path extending from gap 44 toward the first end of plate 10, along which the oil must flow in order to reach the oil outlet opening 26. This has the effect of lengthening the flow path between the oil inlet and outlet openings 22, 26, thereby maximizing use of the plate surface area and optimizing heat transfer.

Preferably, the channel 116 is coplanar with the first fluid outlet opening 26 and with the first recessed barrier portion 46, i.e. it is recessed relative to the base 12. In the preferred embodiment shown in the drawings, the channel 116 preferably extends continuously along axis P from the oil outlet opening 26 to the second end 28 of plate 10.

As shown in the drawings, a pair of grooves 118 and 120 is formed in the top surface 14 of plate 10. Each groove 118, 120 extends along a side of one of the legs 108, 110 opposite the channel 116. Preferably, the grooves 118, 120 are coplanar with the channel 116 and each have an end communicating with the channel 116 at the terminal end 112 or 114 of one of the legs 108 or 110.

Lastly, the base 12 of oil core plate 10 is provided on its top surface 14 with a pair of upstanding bosses 122, 124 having respective upper surfaces 126, 128 in which the coolant inlet and outlet openings 30, 32 are formed. In the preferred embodiment shown in the drawings, the upper surfaces 126, 128 of bosses 122, 124 are raised relative to the base 12 and relative to the first raised barrier portion 36, with the corresponding coolant inlet and outlet openings 80, 82 of the coolant core plate 60 being coplanar with the base 62 thereof. It will, however, be appreciated that this is not necessarily the case. For example, the upper surfaces 126, 128 of raised bosses 122, 124 could be coplanar with the upper surface 38 of raised barrier portion 36, and the coolant core plate could be provided with corresponding recessed bosses (not shown) which come into sealed contact with the raised bosses 122, 124.

It will further be appreciated from the drawings that the first recessed barrier portion 46 of the oil core plate 10 and the second raised barrier portion 86 of coolant core plate 60 correspond in size, shape and location so that their respective lower and upper surfaces 48 and 88 are in sealed contact with one another in the assembled heat exchanger. Preferred features of first recessed barrier portion 46 are now described below with reference to the drawings. Except where noted to the contrary, the following discussion also applies to the second raised barrier portion 86 of plate 60, and corresponding features of the second raised barrier portion 86 are identified in the drawings with corresponding, primed reference numerals.

It will be noted that the first recessed barrier portion 46 is comprised of a plurality of bosses, including a first boss 130 in which the oil inlet opening 22 is formed and a second boss 132 in which the oil outlet opening 26 is formed. In preferred embodiments where the plate 10 includes a further opening 34, the barrier portion 46 further comprises a third boss 134 located between and in close proximity to the first and second bosses 130, 132. The third boss 134 surrounds the further opening 34 and is located radially inwardly of the approximately circular rib comprising the first portion 106 of the first raised barrier portion 36, discussed above.

As shown in the drawings, the first coolant flow gap 54 is located between the first boss 130 and the first end 24 of plate 10. In addition a second coolant flow gap 136 is located between the first boss 130 and the third boss 134, and a third coolant flow gap 138 is located between the second boss 132 and the third boss 134. The first gap 54 is preferably wider than the second and third gaps 136, 138 so that most of the coolant flowing from the coolant inlet opening 30 to the coolant outlet opening 32 will be forced to flow around the first boss 130, thereby maximizing the distance travelled by the coolant and maximizing use of the plate surface area, thereby optimizing heat transfer.

As shown in the drawings, the second boss 132 is elongate and extends axially from the oil outlet opening 26 to the second end 28 of plate 10, thereby preventing short circuit flow of coolant across the plate between inlet and outlet openings 30, 32. It will also be appreciated that the second boss is coextensive with the recessed channel 116, discussed above, which is formed in the top surface 14 of plate 10.

The first recessed barrier portion 46 further comprises a pair of legs 140, 142 to help direct flow of the coolant. These legs 140, 142 extend alongside and in close proximity to the second boss 132 and are coincident with the grooves 118, 120 on the other side of the plate 10. Each of the legs 140, 142 has a free end which terminates proximate the third coolant flow gap 138 and an opposite end which is joined to a side of the second boss 132. The legs 140, 142 are spaced from the second boss 132 by a pair of narrow grooves 144, 146, comprising the undersides of the legs 108, 110 formed in the top surface 14 of plate 10. The grooves 144, 146 are preferably coplanar with a groove 148 surrounding the third boss 134, which forms the underside of the first portion 106 of the first raised barrier portion 36, described above.

Figure 9:
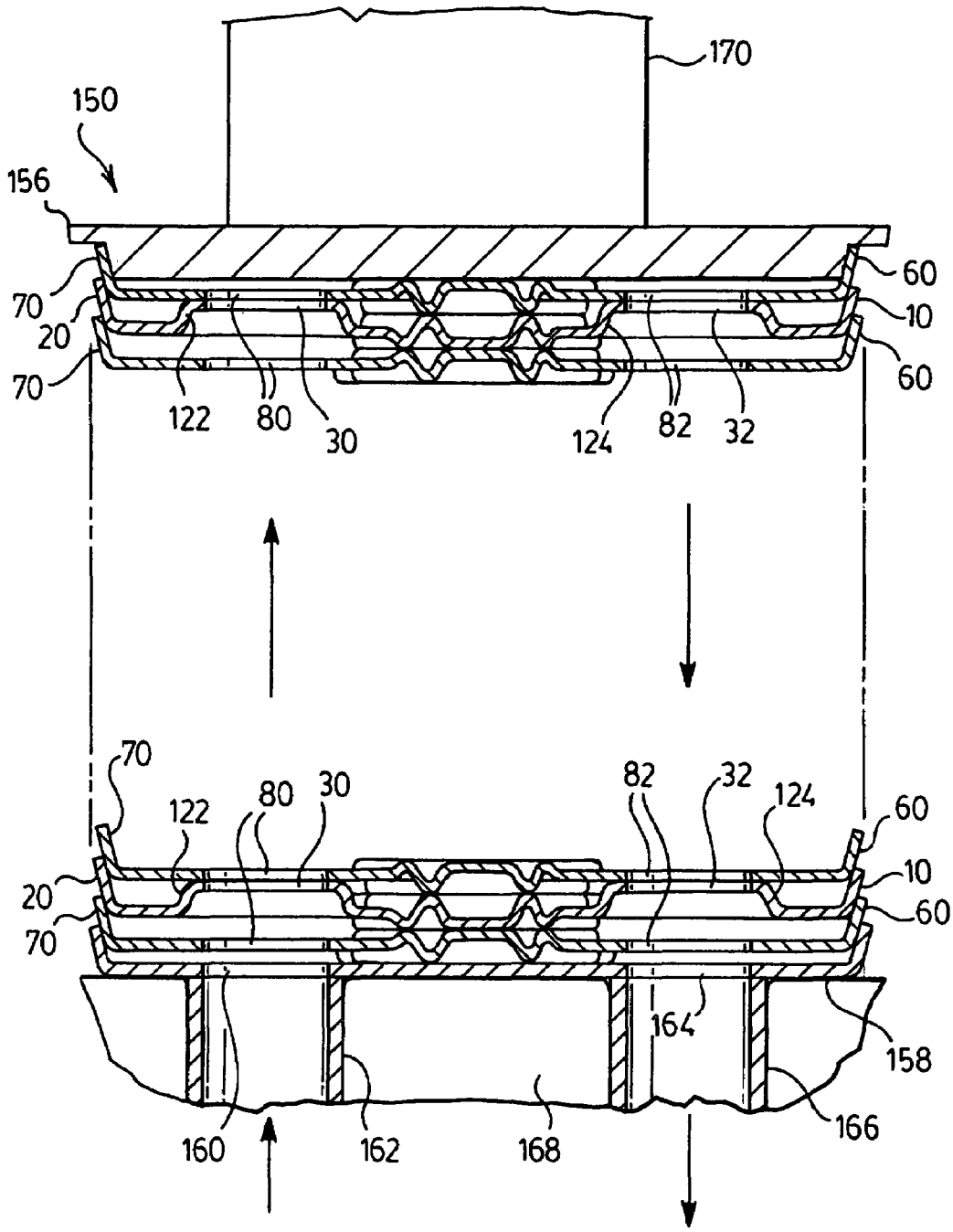
FIG. 9 is a cross sectional view of a heat exchanger according to a preferred embodiment of the invention comprising a stack of oil core plates as shown in FIGS. 1, 2, 5 and 6 and a plurality of coolant core plates as shown in FIGS. 3, 4, 7 and 8, with the oil core plates being sectioned along line 9—9 in FIG. 5 and the coolant core plates being sectioned along line 9'—9' in FIG. 7.
Figure 10:
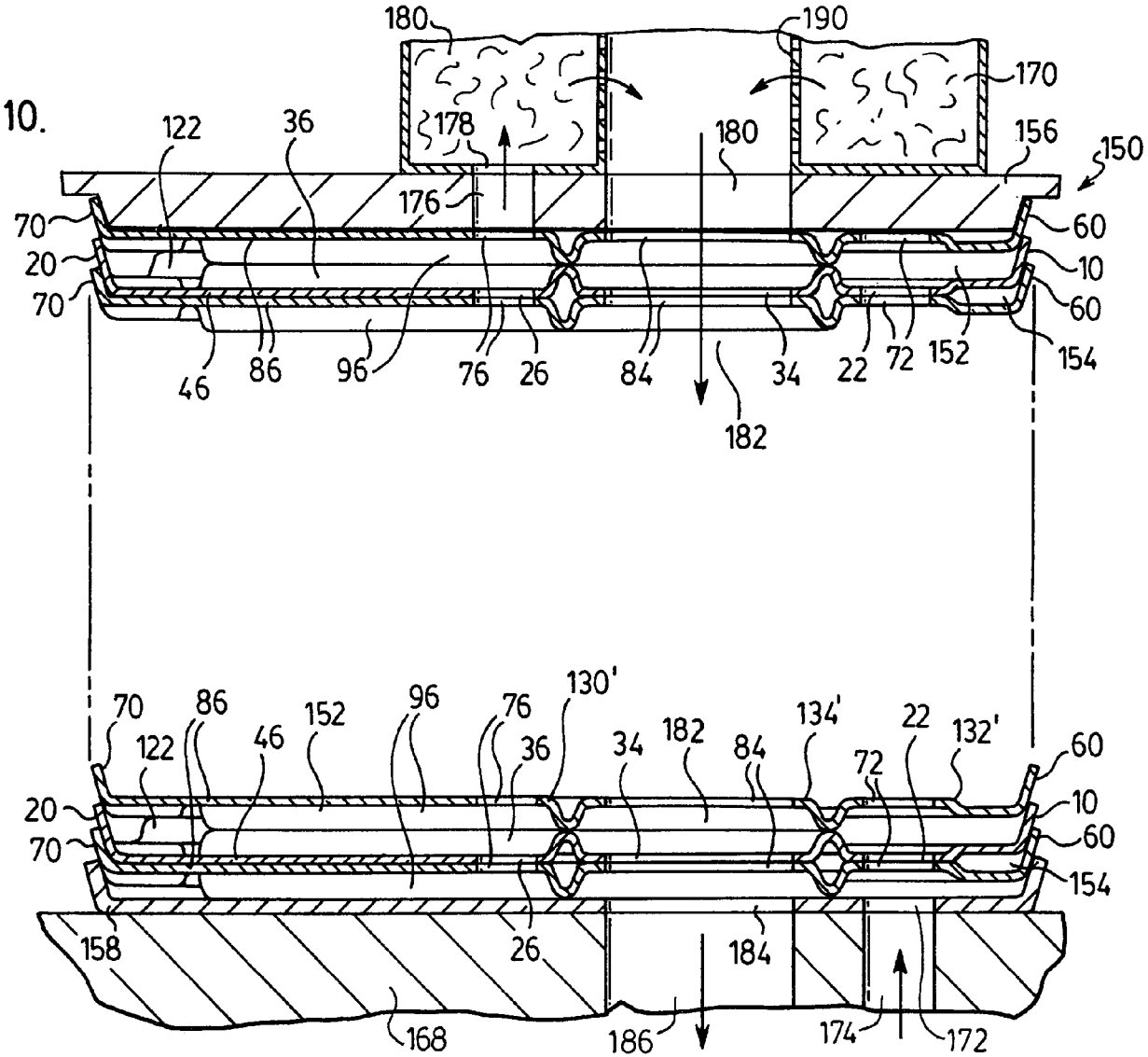
FIG. 10 is a further cross sectional view of the heat exchanger shown in FIG. 9, with the oil core plates being sectioned along line 10—10 in FIG. 5 and the coolant core plates being sectioned along line 10'—10' in FIG. 7.

Referring now to FIGS. 9 and 10 of the drawings, there is illustrated a heat exchanger 150 according to the invention comprising a plurality of oil core plates 10 and a plurality of coolant core plates 60 which are comprised of one or more metals such as aluminum, stainless steel or copper alloy. Alternatively, the plates could comprise a non-metallic material such as plastic, preferably having high thermal conductivity. The plates 10, 60 are disposed in alternating stacked relationship, with all plates 10, 60 facing the same direction and with the flanges 20, 70 of adjacent plates 10, 60 being in sealed nested contact with one another, thereby sealing together the peripheries 18, 68 of adjacent core plates 10, 60. In the drawings, all plates 10, 60 of heat exchanger 150 are shown facing upwardly and, with the exception of the plates at the top and bottom of the heat exchanger, each oil core plate 10 has its top surface 14 facing the bottom surface 66 of an upwardly adjacent coolant core plate 60 and each coolant core plate 60 has its top surface 64 facing the bottom surface 16 of an upwardly adjacent oil core plate 10. Only some of the plates comprising heat exchanger 150 are shown in the drawings.

The bases 12, 62 of alternating oil and coolant core plates 10, 60 are in spaced relation to one another to define a series of alternating oil flow passages 152 and coolant flow passages 154. Oil flow passages 152 are formed between the top surfaces 14 of oil core plates 10 and the bottom surfaces 66 of upwardly adjacent coolant core plates 60. Similarly, coolant flow passages 154 are formed between the top surfaces 64 of coolant core plates 60 and the bottom surfaces 16 of upwardly adjacent oil core plates 10.

It will be seen from the drawings of heat exchanger 150 that the first raised barrier portions 36 of the oil core plates 10 are in sealed contact with the corresponding second recessed barrier portions 96 of an upwardly adjacent coolant core plate 60, the barrier portions 36, 96 being in sealed contact along their upper and lower surfaces 38, 98, respectively. As mentioned above, the barrier portions 36, 96 are preferably identical in size and shape and are of sufficient height so that each raised element making up barrier portion 36 (i.e. first portion 106 and legs 108, 110) is in sealed contact with a corresponding recessed element of barrier portion 96 (i.e. first portion 106' and legs 108', 110'). Furthermore, the oil flow gaps 44 and 104 of the respective oil and coolant core plates 10, 60 are aligned, as are the channels 116, 116' and the grooves 118, 118', 120 and 120' of respective plates 10, 60.

It will also be seen that the second raised barrier portions 86 of the coolant core plates 60 are in sealed contact with the corresponding first recessed barrier portions 46 of an upwardly adjacent oil core plate 10, the barrier portions 86, 46 being in sealed contact along their upper and lower surfaces 88, 48, respectively. The barrier portions 46, 86 are preferably identical in size, shape and height so that each recessed element making up barrier portion 46 (i.e. first boss 130, second boss 132, third boss 134 and legs 140, 142) is in sealed contact with a corresponding raised element of barrier portion 86 (i.e. first boss 130', second boss 132', third boss 134' and legs 140', 142'). Furthermore, the first coolant flow gaps 54 and 94 of the respective oil and coolant core plates 10, 60 are aligned, as are the second coolant flow gaps 136, 136', the third coolant flow gaps 138, 138' and the narrow grooves 144, 144', 146 and 146' of the respective plates 10, 60.

It will also be appreciated that the bosses 122, 124 formed in the top surface 14 of each oil core plate 10, in which the coolant inlet and outlet openings 30, 32 are formed, are sealed along their upper surfaces 126, 128 to the bottom surface 66 of an upwardly adjacent coolant core plate 60. Furthermore, the plates 10, 60 are sealed together with the openings of each oil core plate 10 (i.e. oil inlet opening 22, oil outlet opening 26, coolant inlet opening 30, coolant outlet opening 32, further opening 34) being in alignment with the corresponding openings of each coolant core plate 60 (i.e. oil inlet opening 72, oil outlet opening 76, coolant inlet opening 80, coolant outlet opening 82, further opening 84).

Where the plates are made of a metallic material, they may be provided with a brazing filler metal in the form of a cladding, a coating or shim plates so that, after assembly of the plurality of oil core plates 10 and the plurality of coolant core plates 60 as described above, the assembled plates 10, 60 may be disposed in a brazing furnace or other suitable heating means thereby to provide the above-described sealing contact between the plates 10, 60. Metallic plates can also be joined by alternate suitable means such as welding, adhesive bonding, or mechanical assembly using sealing gaskets. Non-metallic plates can be joined by other means, such as ultrasonic welding.

Ends plates 156 and 158 are schematically shown in the drawings for sealing the ends of the plate stack and connecting it to the oil and coolant systems. FIG. 9 shows lower end plate 158 being provided with a coolant inlet opening 160 and a coolant inlet fitting 162, and also with a coolant outlet opening 164 and a coolant outlet fitting 166. The coolant inlet opening 160 of plate 158 is in communication with the coolant flow passages 154 and is aligned with the coolant inlet openings 30, 80 of the stacked plates 10, 60. Similarly, the coolant outlet opening 164 of plate 158 is in communication with the coolant flow passages 154 and is aligned with the coolant outlet openings 32, 82 of the plates 10, 60. The aligned inlet openings 30, 80 and aligned outlet openings 32, 82 are closed at the upper end of heat exchanger 150 by the upper end plate 158.

As shown in FIG. 10, the lower end plate 158 may preferably be mounted to an engine block 168 and the upper end plate may preferably be mounted to an oil filter 170. The lower end plate 158 is provided with an oil inlet opening 172 through which oil enters the heat exchanger 150 from an internal flow passage 174 in the engine block 168. The oil inlet opening 172 of lower end plate 158 is in communication with oil flow passages 152 and is aligned with the oil inlet openings 22, 72 of the stacked plates 10, 60. The upper end plate 156 is provided with an oil outlet opening 176 which is in communication with an inlet opening 178 of the oil filter 170. The oil outlet opening 176 is also in communication with oil flow passages 152 and is aligned with the oil outlet openings 26, 76 of the plates 10, 60.

The upper end plate 156 is also provided with an oil return opening 180 through which filtered oil is returned to the engine block 168 via the aligned further openings 34, 84 of the stacked plates 10, 60 which together form an oil return passage 182 which is sealed from the oil flow passages 152. The oil return passage 182 is in communication with an oil return opening 184 in the lower end plate 158 and with an oil return passage 186 of the engine block 168.

In operation, oil from engine block 168 enters the heat exchanger 150 through the oil inlet opening 172 in the lower end plate 158 and then flows into one end of the aligned oil inlet openings 22, 72. Since the other end of the aligned openings 22, 72 is blocked by upper end plate 156, the oil is forced to flow through the oil flow passages 152 as indicated in chain-dotted lines in FIG. 5. In order to flow from the oil inlet opening 22 to the oil outlet opening 26, the oil must flow alongside the first raised barrier portion 36 toward the second end 28 of plate 10, through oil flow gap 44 and along channel 116 to oil outlet opening 26. Therefore, the oil must flow over a substantial portion of the base 12 of each plate 10 as it flows from the oil inlet opening 22 to the oil outlet opening 26.

The oil flowing from the heat exchanger through the aligned oil outlet openings 26, 76 flows through the oil outlet opening 176 in the upper end plate 156 and into oil filter 170 where it passes through a filter medium 188 and enters a perforated central tube 190 for return to the engine block 168 through the oil return passage 182 and the oil return openings 180, 184. The flow of oil through the engine block 168, heat exchanger 150 and oil filter 170 is indicated by arrows in FIG. 10. In this embodiment, it will be appreciated that the oil is cooled before it is filtered.

In the alternative, the oil flow may be reversed so that it is filtered before being cooled by heat exchanger 150. In this embodiment, the oil flows from passage 186 of engine block 168 into the passage 182 of heat exchanger 150. The oil flows through passage 182 and enters the oil filter 170 to be filtered. The filtered oil then enters the heat exchanger 150 through opening 176 in upper end plate 156 and exits the heat exchanger through the opening 172 in the lower end plate 158, returning to engine block 168 through passage 174.

In the preferred heat exchanger 150 shown in FIG. 10, the aligned inlet openings 22, 72 are sealed from direct flow communication with the oil filter 170 under all operating conditions, i.e. the oil must pass through the oil flow passages 152 before entering the oil filter 170. It may be preferred to provide a further opening (not shown) in the upper end plate 156 which is aligned with the inlet openings 22, 72 of plates 10, 60 and which is provided with a by-pass valve (not shown), for example an active pressure or thermal relief valve, to permit oil to by-pass the heat exchanger under start-up conditions and directly enter the oil filter. Such by-pass valves are known in the art and do not form part of the present invention. Alternatively, it may be preferred to provide a passive by-pass orifice, in the form of a calibrated opening in the upper end plate 156, so as to permit controlled flow of fluid to the oil filter under various conditions.

As shown in FIG. 9, coolant enters the heat exchanger 150 through a coolant inlet opening 160 in the lower end plate 158 and then flows into one end of the aligned coolant inlet openings 30, 80. Since the other end of the aligned openings 30, 80 is blocked by upper end plate 158, the coolant is forced to flow through the coolant flow passages 154 following the path indicated in chain-dotted lines in FIG. 7. In order to flow from the coolant inlet opening 30 to the coolant outlet opening 32, the coolant must flow along one side of the second raised barrier portion 86 toward the first end 24 of plate 10, through the first coolant flow gap 54, then alongside the other side of barrier portion 86 toward the second end 28 of plate 10, to the coolant outlet opening 32. Therefore, the coolant must flow over a substantial portion of the base 62 of each coolant core plate 60 as it flows from the coolant inlet opening 30 to the coolant outlet opening 32. It will be appreciated that a relatively small amount of coolant will flow through the second and third coolant flow gaps 136, 138, but this has a minimal impact on the performance of heat exchanger 150.

The heat exchanger 150 according to the invention thus achieves a high rate of heat transfer between the oil and the coolant. It will, of course, be appreciated that the openings 32, 82 could be the coolant inlet openings with the openings 30, 80 being the coolant outlet openings. Furthermore, the openings 26, 76 could function as the oil inlet openings, with the openings 22, 72 functioning as the oil outlet openings.

It will be appreciated that the height of each oil flow passage 152 and the height of each coolant flow passage 154 is partly dependent on the extent of the nesting of the alternate plates 10, 60 and therefore is partly dependent on the angle of inclination of the flanges 20, 70. It will also be appreciated that the heights of the flow passages 152, 154 are also partly dependent on the heights of the barrier portions 36, 46, 86, 96 and the heights of bosses 122, 124.

Turbulisers which may be of conventional form, such as the turbulisers 60 of U.S. Pat. No. 6,244,334 issued on Jun. 12, 2001 to Wu, et al., are preferably disposed in one or more of the oil flow passages 152 and may also be disposed in one or more of the coolant flow passages 154, these turbulisers serving to disrupt the oil or coolant flow in each of the oil or coolant flow passages 152, 154 in which they are installed and to disturb the boundary layers of the oil or coolant flow at the surfaces of the plates 10, 60, thereby improving the efficiency of heat transfer from the oil to the coolant in the heat exchanger 150. For clarity, these turbulisers are shown only in FIGS. 5 and 7 and only in outline denoted by broken lines 178, 180. The turbulisers 178, 180 have a high pressure drop (HPD) flow direction in which maximum turbulising of the oil flow occurs but with a high pressure drop in the oil flow, and a transverse low pressure drop (LPD) flow direction in which there is reduced turbulising of the oil flow but with low pressure drop in the oil flow. As desired, the turbulisers 178, 180 may each be disposed in either the HPD or LPD flow direction.

Instead of using turbulisers 178, 180, the base 62 of one or more of the coolant core plates 60 may be formed with spaced protrusions such as ribs and/or dimples, similar to those shown in FIGS. 1 and 2 of U.S. Publication No. 2004/0040697 A1 (St. Pierre et al.) published on Mar. 4, 2004 and incorporated herein by reference in its entirety.

Although the invention has been described in connection with certain preferred embodiments, it is not limited thereto. Rather, the invention includes all embodiments which may fall within the scope of the following claims.

What is claimed is:

1. A heat exchanger comprising a plurality of first fluid core plates and a plurality of second fluid core plates, each of the core plates comprising a periphery; a first end; a second end; a generally flat base having a top surface and a bottom surface; a first fluid inlet opening proximate the first end of the plate; a first fluid outlet opening spaced from the first fluid inlet opening toward the second end of the plate; a second fluid inlet opening; and a second fluid outlet opening;

wherein the first fluid inlet and outlet openings are spaced from one another along a plate axis and wherein the second fluid inlet and outlet openings are located on opposite sides of the plate axis;

each of the first fluid core plates further comprises a first raised barrier portion having an upper surface which is raised relative to the top surface of the base and relative to the first fluid inlet and outlet openings, the first raised barrier portion having a first end proximate the first fluid inlet opening and a second end spaced from the first fluid inlet opening toward the second end of the plate, the second end of the first raised barrier portion being spaced toward the second end of the plate relative to the first fluid outlet opening, with a first fluid flow gap being provided between the second end of the first raised barrier portion and the second end of the plate through which the first fluid can flow between the first fluid inlet and outlet openings;

each of the first fluid core plates further comprises a first recessed barrier portion having a lower surface which is recessed relative to the bottom surface of the base, with both the first fluid inlet and outlet openings being formed in the first recessed barrier portion, the first recessed barrier portion having a first end proximate the first end of the plate and a second end proximate the second end of the plate, wherein a second fluid flow gap is provided through which the second fluid can flow between the second fluid inlet and outlet openings, the second fluid flow gap being spaced toward the first end of the plate relative to at least one of the second fluid inlet and outlet openings;

each of the second fluid core plates further comprises a second raised barrier portion having an upper surface which is raised relative to the top surface of the base, with both the first fluid inlet and outlet openings of the second plate being formed in the second raised barrier portion, the second raised barrier portion having a first end proximate the first end of the plate and a second end proximate the second end of the plate, wherein a second fluid flow gap is provided through which the second fluid can flow between the second fluid inlet and outlet openings, the second fluid flow gap being spaced toward the first end of the plate relative to at least one of the second fluid inlet and outlet openings;

each of the second fluid core plates further comprises a second recessed barrier portion having a lower surface which is recessed relative to the bottom surface of the base and relative to the first fluid inlet and outlet openings, the second recessed barrier portion having a first end proximate the first fluid inlet opening and a second end spaced from the first fluid inlet opening toward the second end of the plate, the second end of the second recessed barrier portion being spaced toward the second end of the plate relative to the first fluid outlet opening, with a first fluid flow gap being provided between the second end of the second recessed barrier portion and the second end of the plate through which the first fluid can flow between the first fluid inlet and outlet openings;

the first fluid core plates and the second fluid core plates being in alternating stacked relationship with the periphery of each first fluid core plate being sealed to the periphery of an adjacent second fluid core plate to form a plurality of fluid flow passages;

said plurality of fluid flow passages comprising a plurality of first fluid flow passages for flow of the first fluid, each of the first fluid flow passages being formed between the top surface of a first fluid core plate and the bottom surface of an upwardly adjacent second fluid core plate, with the upper surface of the first raised barrier portion of the first fluid core plate being in sealed contact with the lower surface of the second recessed barrier portion of the second fluid core plate and with the gap of the first raised barrier portion communicating with the gap of the second recessed barrier portion, such that the first fluid can flow from the first fluid inlet opening, through the first fluid flow passage, and through the gaps to the first fluid outlet opening;

said plurality of fluid flow passages further comprising a plurality of second fluid flow passages for flow of the second fluid, each of the second fluid flow passages being formed between the top surface of a second fluid core plate and the bottom surface of an upwardly adjacent first fluid core plate, with the upper surface of the second raised barrier portion of the second fluid core plate being in sealed contact with the lower surface of the first recessed barrier portion of the first fluid core plate and with the gap of the second raised barrier portion communicating with the gap of the first recessed barrier portion, such that the second fluid can flow from the second fluid inlet opening, through the second fluid flow passage, and through the gaps to the second fluid outlet opening;

wherein the first fluid flow passages alternate with the second fluid flow passages.

2. The heat exchanger of claim 1, wherein the first raised barrier portion of the first fluid core plate and the second recessed barrier portion of the second fluid core plate each comprise:

a first portion positioned between the first fluid inlet and outlet openings and including the first end of the barrier portion; and a pair of legs extending from the first portion toward the second end of the plate.

3. The heat exchanger of claim 2, wherein the legs have terminal ends located at the second end of the barrier portion, the terminal ends of the legs being proximate to the second end of the plate.

4. The heat exchanger of claim 3, wherein an axial distance from the terminal ends of the legs to the second end of the plate is less than an axial distance from the first fluid outlet opening to the second end of the plate, said axial distance from the terminal ends of the legs to the second end of the plate defining said gap between the barrier portion and the second end of the plate.

5. The heat exchanger of claim 4, wherein the legs are spaced from one another and extend along opposite sides of the first fluid outlet opening for at least a portion of their lengths.

6. The heat exchanger of claim 5, wherein a channel is defined between the legs, the channel extending along the plate axis between the first fluid outlet opening and the terminal ends of the legs.

7. The heat exchanger of claim 6, each of the first and second fluid core plates further comprising a pair of grooves, each of which extends along a side of one of the legs opposite said channel, one end of the groove being located at the terminal end of the leg and communicating with the channel.

8. The heat exchanger of claim 7, wherein the grooves are coplanar with the channel.

9. The heat exchanger of claim 6, wherein said sealed contact between the first raised barrier portion and second recessed barrier portion is provided by sealed contact between the legs of the respective barrier portions and by sealed contact between the first portions of the respective barrier portions, such that the first fluid flowing from the first fluid inlet opening can only enter the first fluid outlet opening by flowing to the terminal ends of the legs, through the gap into the channel, and through the channel toward the first end of the plate.

10. The heat exchanger of claim 5, wherein the channel is coplanar with the first fluid outlet opening and with the first recessed barrier portion.

11. The heat exchanger of claim 10, wherein the channel extends from the first fluid outlet opening to the second end of the plate.

12. The heat exchanger of claim 2, wherein said first portion of the barrier portion comprises a rib surrounding a further opening in the base.

13. The heat exchanger of claim 1, wherein each of the first fluid core plates further comprises a pair of bosses having upper surfaces raised relative to the top surface of the base and relative to the first raised barrier portion, wherein the second fluid inlet and outlet openings are formed in the upper surfaces of the bosses.

14. The heat exchanger of claim 1, wherein the first recessed barrier portion of the first fluid core plate and the second raised barrier portion of the second fluid core plate each comprise:

a first boss in which the first fluid inlet opening is formed; and a second boss in which the second fluid inlet opening is formed.

15. The heat exchanger of claim 14, wherein said gap through the barrier portion is located between the first boss and the first end of the plate.

16. The heat exchanger of claim 14, wherein the second boss is elongate and extends axially from the first fluid outlet opening to the second end of the plate.

17. The heat exchanger of claim 14, further comprising a third boss located between and in close proximity to the first and second bosses, wherein the third boss surrounds a further opening in the base.

18. The heat exchanger of claim 17, wherein additional gaps are formed between the first boss and the third boss and between the second boss and the third boss.

19. The heat exchanger of claim 14, wherein the barrier portion further comprises a pair of legs extending alongside the second boss and in close proximity thereto, each of the legs being joined at one of its ends to a side of the second boss, wherein a narrow groove is formed between the second boss and each of the legs.

20. The heat exchanger according to claim 1, wherein the periphery of each first fluid core plate and the periphery of each second fluid core plate has an outwardly inclined upstanding flange, said upstanding flange of each plate being in sealed nested contact with said upstanding flange of an adjacent plate to provide said sealing of the peripheries of the plates.

21. The heat exchanger according to claim 1, wherein said sealed contact comprises brazing contact.

22. The heat exchanger according to claim 1, wherein a turbulizer is provided in at least one of the first fluid flow passages and/or in at least one of the second fluid flow passages.

23. The heat exchanger according to claim 1, wherein the base of at least one of the first fluid core plates and/or the base of at least one of the second fluid core plates is provided with a plurality of spaced protrusions.

24. The heat exchanger according to claim 23, wherein said protrusions are selected from the group consisting of ribs and dimples.

* * * * *